United States Patent [19]

Goss et al.

[11] 4,280,628

[45] Jul. 28, 1981

[54] ANTI-TWO BLOCK SYSTEM

[76] Inventors: John B. Goss, 7627 Beach Cove La.; William D. Morrow, 10206 Amblewood, both of Houston, Tex. 77072

[21] Appl. No.: 38,814

[22] Filed: May 14, 1979

Related U.S. Application Data

[63] Continuation-in-part of Ser. No. 892,018, Mar. 31, 1978, Pat. No. 4,184,600.

[51] Int. Cl.[3] ..... B66C 15/00

[52] U.S. Cl. ..... 212/266; 212/152; 212/255

[58] Field of Search ..... 212/1, 28, 39 R, 39 B, 212/39 MS, 39 DB, 58 R, 59 R, 86, 152, 220, 255, 266; 254/139, 139.1, 174

[56] References Cited

U.S. PATENT DOCUMENTS

| | | | |
|---|---|---|---|
| 1,834,985 | 12/1931 | Stoner | 212/39 B |
| 2,627,983 | 2/1953 | Lathers | 254/139.1 X |
| 2,906,501 | 9/1959 | Brell | 212/59 R X |
| 3,266,638 | 8/1966 | Popov | 212/39 R |
| 4,067,447 | 1/1978 | Goss et al. | 212/86 |
| 4,170,308 | 10/1979 | Rogers | 212/39 DB |

FOREIGN PATENT DOCUMENTS

| | | | |
|---|---|---|---|
| 681442 | 10/1952 | United Kingdom | 212/86 |
| 594018 | 2/1978 | U.S.S.R. | 212/39 R |

*Primary Examiner*—Johnny D. Cherry
*Attorney, Agent, or Firm*—Pravel, Gambrell, Hewitt, Kirk, Kimball & Dodge

[57] ABSTRACT

A new and improved anti-two block system adapted to be used with a crane for the prevention of damage to the boom tip of the boom of the crane by the travelling member wherein the two block system of the present invention includes an engaging mechanism movably mounted with the boom tip for engaging the travelling member when the travelling member moves into close proximity to the boom tip during lifting operations of the travelling member with the crane for the prevention of damage thereto.

9 Claims, 5 Drawing Figures

ANTI-TWO BLOCK SYSTEM

CROSS-REFERENCE TO RELATED APPLICATIONS

This is a continuation-in-part of United States Patent Application Ser. No. 892,018, filed on Mar. 31, 1978 now U.S. Pat. No. 4,184,600.

TECHNICAL FIELD OF THE INVENTION

The field of this invention relates to anti-two block systems for preventing damage to the boom tip of a crane should a travelling member be inadvertently drawn into the boom tip of the crane.

PRIOR ART

For lifting devices, such as all types of cranes, two blocking, as it is called, provides a very significant health and safety factor for those working about such lifting operations. Two blocking is the lifting by the lifting line of a travelling member up into the boom tip of a crane resulting in damage to the boom tip and sheaving mechanisms therewith, with attendant damage to the travelling member and/or the load. Such a two blocking situation typically occurs when the lifting line is hoisted too rapidly by an operator not paying proper attention to the proximity of the travelling member to the supporting member, such as the boom tip of a crane, resulting in the travelling member colliding with the boom tip structure. Not only is there a substantial risk that the lifting or hoisting line may snap due to such instantaneous high load situations resulting in a free falling load with the potential danger to those below, also the line, upon snapping, may whip into proximity of the operator resulting in substantial risk of injury thereto.

Attempts to solve these problems have included those such as detailed in U. S. Pat. No. 4,067,447 wherein a hydraulically actuated sensing mechanism is used to sense the movement of the travelling member when in proximity to the boom tip with an attendant communication with a hoisting actuator mechanism such that sensing device effects movement of the hoisting lever of the crane. This movement caused by the travelling member engaging such a sensing device results in discontinuance of the lifting force exerted on the lifting line. U.S. Pat. No. 4,019,852 discloses the use of a protective plate rigidly affixed to the boom tip to prevent damage to the sheaves adjacent the boom tip. However, no maintenance free, strictly mechanical device is known that ensures an effective anti-two blocking system capable of preventing two blocking at substantially all boom angles of operation of the crane.

SUMMARY OF THE INVENTION

The present invention relates to a new and improved anti-two block system adapted to be used with a crane adjacent the boom tip thereof and including engaging members mounted with the boom tip for engaging the travelling member when the travelling member moves into close proximity to the boom tip during lifting operations of the travelling member with the crane.

DESCRIPTION OF THE PREFERRED EMBODIMENT

Figure 1:
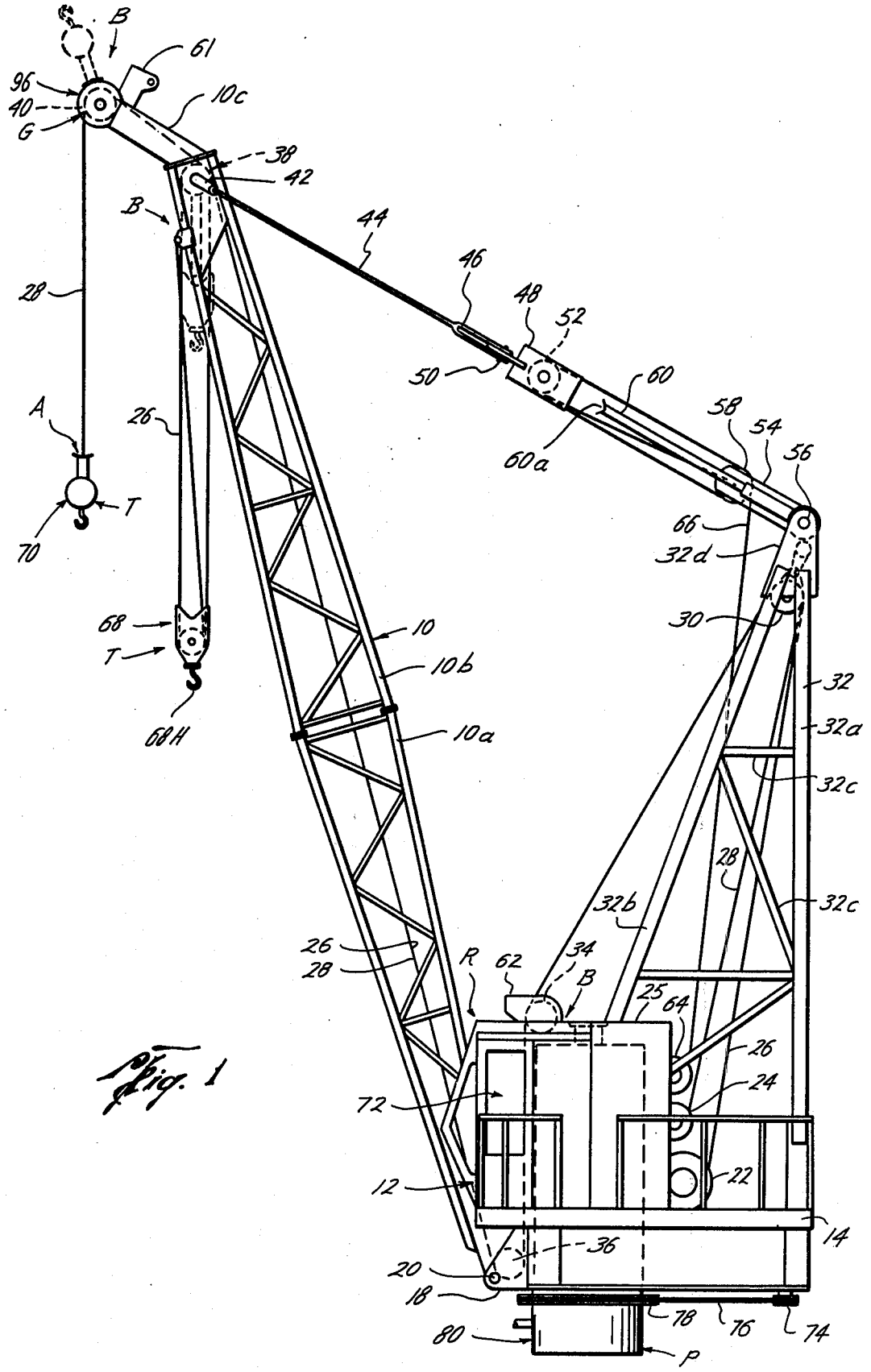
FIG. 1 is an elevational view of a crane assembly capable of incorporating the anti-two block system of the present invention.

In the drawings, the letter B designates the anti-two block system of the present invention. The anti-two block system B is adapted to be used in any type of lifting device such as crane assembly C. Unless otherwise noted, the components of this invention are made of steel capable of taking heavy stresses and strains without failure, although other suitable, high-strength materials may be used if desired.

As shown in FIG. 1, the crane assembly C, which may include a pedestal crane as shown or any other type of suitable crane, may preferably include a boom designated generally as 10 being movably affixed to the upper works, designated generally as 12, which is adapted to be disposed about a pedestal P. The pedestal P may be mounted with an offshore platform, permanently embedded in the ground, mounted with a movable vehicular frame or in any other way rigidly affixed to a supporting structure (not shown). The upper works 12 generally includes a platform 14 adapted to be disposed about the pedestal P. A revolving turntable R is in turn mounted for movement about the pedestal P.

The upper works 12 provides an appropriate boom support 18 wherein the boom 10 may be pivotally mounted therewith by means of pin joint 20. Preferably as shown in FIG. 1, the main hoist 22 and auxiliary hoist 24 are mounted with an appropriate shelter 25 mounted on platform 14. As discussed more fully hereinbelow preferably hoists 22, 24 are hydraulically actuated. The main hoist line 26 and auxiliary hoist line 28 extend from the main hoist 22 and auxiliary hoist 24, respectively, up and into sheave 30 supported by boom tower 32 adjacent upper end **32*d* thereof. Hoist lines 26, 28 extend from the sheave 30 over idler sheave 34, preferably mounted with the shelter 25, from idler sheave 34 to idler sheave 36 which is preferably mounted with the platform 14 adjacent pin joint 20. From sheave 36, the hoist lines 26, 28 are located along the length and therethrough the central portion of the boom 10 to sheaves 38 and 40**, respectively.

As is known, the boom 10 may be made up of multiple sections such as boom sections **10*a*, 10*b* or any number of additional sections in addition thereto (not shown) that would be appropriate for the given job to be done. As shown in FIG. 1, boom section 10*a* is pivotally mounted with platform 14 adjacent pin joint 20, with sections 10*a*, 10*b* being appropriately fastened together at the mid point of the boom 10. The sheaves 38, 40 are appropriately affixed to the boom adjacent the boom tip designated generally as 10*c*. Preferably, the boom tower 32 is appropriately affixed to the platform 14 of the upper works 12 with the boom tower 32 having appropriate support members 32*a*, 32*b* and appropriate bracing 32*c*** therebetween to provide the necessary structural strength therefor.

As noted hereinabove, the boom tower 32 supports sheave 30 adjacent the upper end 32*d* and also provides a support for the mechanism necessary for changing the boom angle of the boom 10 with respect to the platform 14 and pedestal P. A connector 42 pivotally affixes the boom tip 10*c* to an appropriate cable 44 which in turn has clevis 46 attached thereto. Clevis 46 is pinned to housing 48 by pin 50, with the housing 48 having sheave 52 mounted therein. Support arms 54 are pivotally mounted with the upper end 32*d* of the boom tower 32 by pin 56, with the support arms 54 supporting sheave 58. Boom stop 60 is further mounted with the upper end 32*d* of the boom tower by pin 56 with end 60*a* adapted to engage sheave 52 upon vertical disposition of the boom 10. Boom stop 62 mounted with the shelter 25 also provides a positive, fail-safe metal-to-metal type boom stop for limiting movement of the boom 10 to a vertical disposition.

Elevation of the boom 10 is controlled by boom hoist 64, preferably mounted with shelter 25, with the boom hoist 64 having boom hoist line 66 extending from hoist 64 to sheave 58 and thereafter threaded between sheaves 52 and 58. Withdrawal of boom hoist line 66 by boom hoist 64 results in the boom being appropriately elevated while conversely, if the boom hoist 64 reels out boom hoist line 66, then boom 10 is appropriately lowered, changing the relative boom angle of the boom 10.

Loads (not shown) are adapted to be picked up and moved about by the crane assembly C by travelling means T which includes the travelling block 68 operatively connected to the main hoist line 26 or the ball-hook assembly 70 operatively connected with the auxiliary hoist line 28. It will be appreciated that the routing of the main hoist line 26 and auxiliary hoist line 28 about sheave 36 and through the length of the boom 10, allows the boom 10 to be raised and/or lowered with a corresponding change in relative boom angle while the relative distance of the travelling members T, such as travelling block 68 and/or ball-hook assembly 70, from the boom tip 10*c* remains substantially constant, preventing two blocking of the travelling block 68 or ball-hook assembly 70 when the boom 10 is lowered. As is known, two blocking occurs when the travelling block 68 or ball-hook assembly 70 actually engages the boom tip 10*c* causing damage thereto, typically occurring while the boom 10 is being lowered.

The platform 14 preferably provides adequate space for the heavy equipment necessary for crane operation. This includes as noted hereinabove, the various hoists such as hoists 22, 24, 64. Other equipment, for example, as an appropriate engine (not shown) may be mounted on platform 14 to provide motive power for a hydraulic pump (not shown) which may provide fluid power for the operation of hoists 22, 24, 64, which is preferred. The platform 14 provides an appropriate location for the controls necessary for the operator to manipulate and control the crane assembly C. Preferably, the controls may be located within the shelter 25 adjacent a location designated as 72. Still further, the platform 14 provides the support for equipment necessary for rotating the crane assembly C about the pedestal P. This, by way of example, may include power means such as a hydraulic motor (not shown) mounted with platform 14 for powering an appropriate bull gear 74, with the power of the bull gear 74 being transferred through power transfer means such as an appropriately sized chain 76, which in turn engages gears 78 which are permanently affixed with the pedestal P. Action of the power means causes movement of the platform 14 about the pedestal P. A bearing assembly (not shown) is adapted to be disposed between the revolving turntable R of the crane assembly C and the pedestal P, the specific structural details of which are the subject of our co-pending United States Patent application Ser. No. 892,018, filed Mar. 31, 1978.

Figure 3:
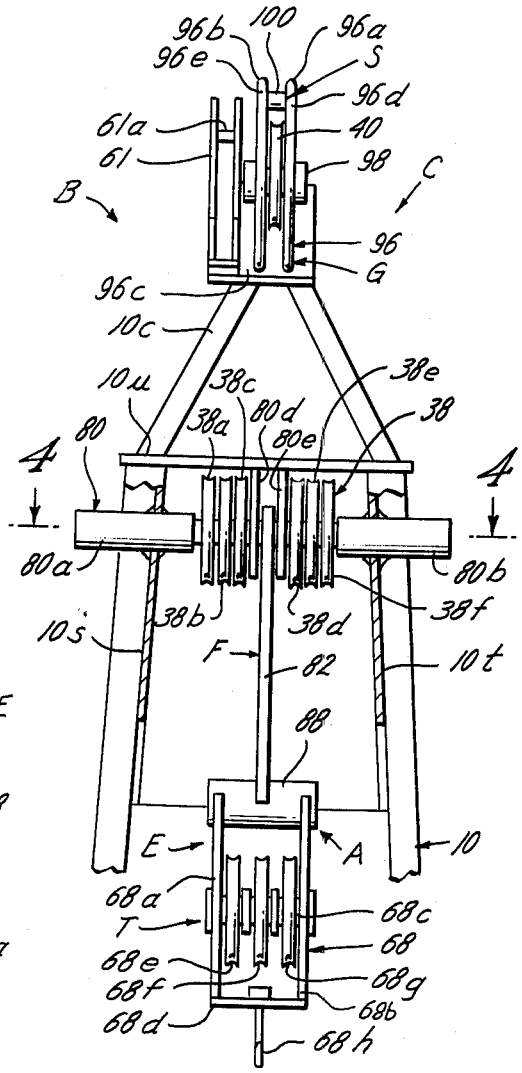
FIG. 3 is an elevational, sectional end view showing the anti-two block system of the present invention taken along the lines 3—3 of FIG. 2.
Figure 5:
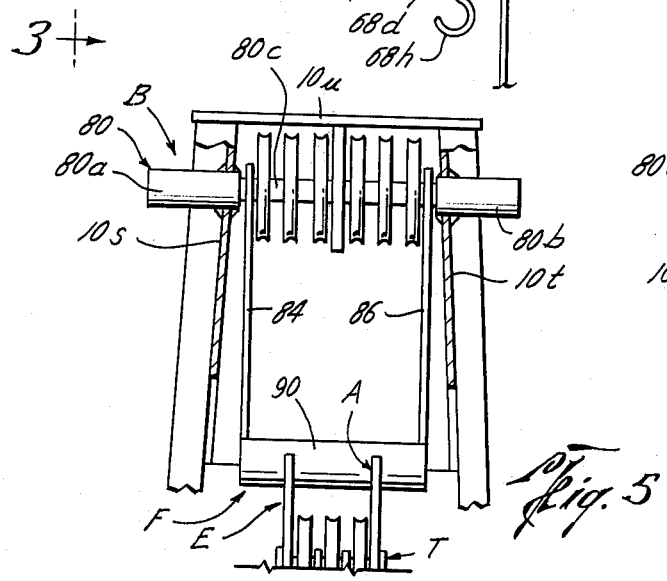
Figure 4:
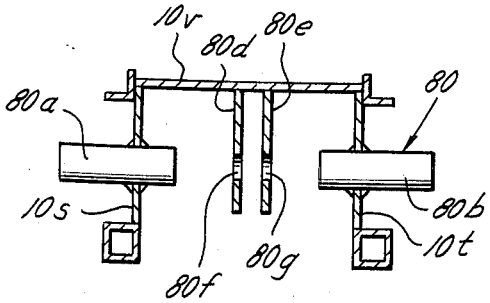
FIG. 4 is a sectional plan view of a sheave carrier of the crane taken along the lines 4—4 of FIG. 3; and, FIG. 5 is an elevational, sectional end view similar to that of FIG. 3, showing an alternative embodiment of the frame member of FIG. 3.

As noted hereinabove, sheaves 38, 40 are mounted with the bottom tip 10*c* of the boom 10 of the crane assembly C. Preferably, sheave 38 is of a multiple sheave assembly as shown in FIG. 3 and includes sheaves 38*a*, 38*b*, 38*c*, 38*d*, 38*e*, 38*f*. Sheave assembly 38 is preferably mounted with the boom tip 10*c* by means of sheave carrier designated generally as 80 (FIGS. 3, 4, 5). The sheave carrier 80 preferably includes a pair of axially aligned tubular members 80*a*, 80*b* that are mounted with boom sections 10*s*, 10*t* adjacent boom tip 10*c* and adapted to receive sheave axle 80*c* that is adapted to extend therebetween tubular members 80*a*, 80*b*, having sheave assembly 38 mounted therewith. Furthermore, supports 80*d*, 80*e* are preferably mounted with boom sections 10*u*, 10*v* for providing interior support for the sheave axle 80*c* and the anti-two block system B of the present invention as discussed more fully hereinbelow. Supports 80*d*, 80*e* are formed with appropriately formed openings 80*f*, 80*g*, respectively, and are capable of receiving the sheave axle 80*c* for appropriate rotational movement therein. The sheave axle 80*c* is adapted to support the sheave assembly 38 in addition to the anti-two block system B of the present invention.

Generally speaking, the anti-two block system B includes engaging means F which may include a frame member F, abutting means A, guide member G and stop means S. The anti-two block system B includes engaging means E movably mounted with the boom tip 10*c* for engaging the travelling member T when the travelling member T moves into close proximity to the boom tip 10*c* during lifting operations of the travelling member T with the crane C.

As noted hereinabove, the travelling member T may include a travelling block 68 and a ball-hook assembly 70. The travelling block 68 includes side supports 68*a*, 68*b* which provide support for sheave axle 68*c*. Side supports 68*a*, 68*b* are rigidly affixed to base support 68*d* which preferably affixes the side supports 68*a*, a proper distance thereapart. The sheave axle 68*c* supports sheaves 68*e*, 68*f*, 38*g*. Base support 68*d* further mounts hook 68*h* therewith with the hook 68*h* adapted to receive and carry the load to be hoisted by a travelling member T in response to action of the crane assembly C. Preferably, the side supports 68*a*, 68*b* are formed with abutting means A of the present invention which includes abutting detents such as abutting detent 68*a* (FIG. 2) formed with the travelling member T for abutting the engaging means E when the travelling member T is moved into close proximity of the boom tip 10*c* to prevent damage thereto.

The anti-two block system B includes a frame member F pivotally mounted with the sheave carrier 80 for unencumbered rotation about the sheave carrier 80 as the boom tip 10*c* moves during lifting operations. The frame member F, as shown in FIG. 3, includes a singular support member 82 having a suitably formed opening therein (not numbered) for receiving the sheave axle 80*c* therein to allow the support member 82 to rotate freely thereabout. Alternatively, the frame member F may include plural support members 84, 86 (FIG. 5), with each of such support members 84, 86 also having suitably formed openings therein to receive the sheave axle 80*c* for rotation of the frame member F about the sheave axle 80*c* of the sheave carrier 80.

Figure 2:
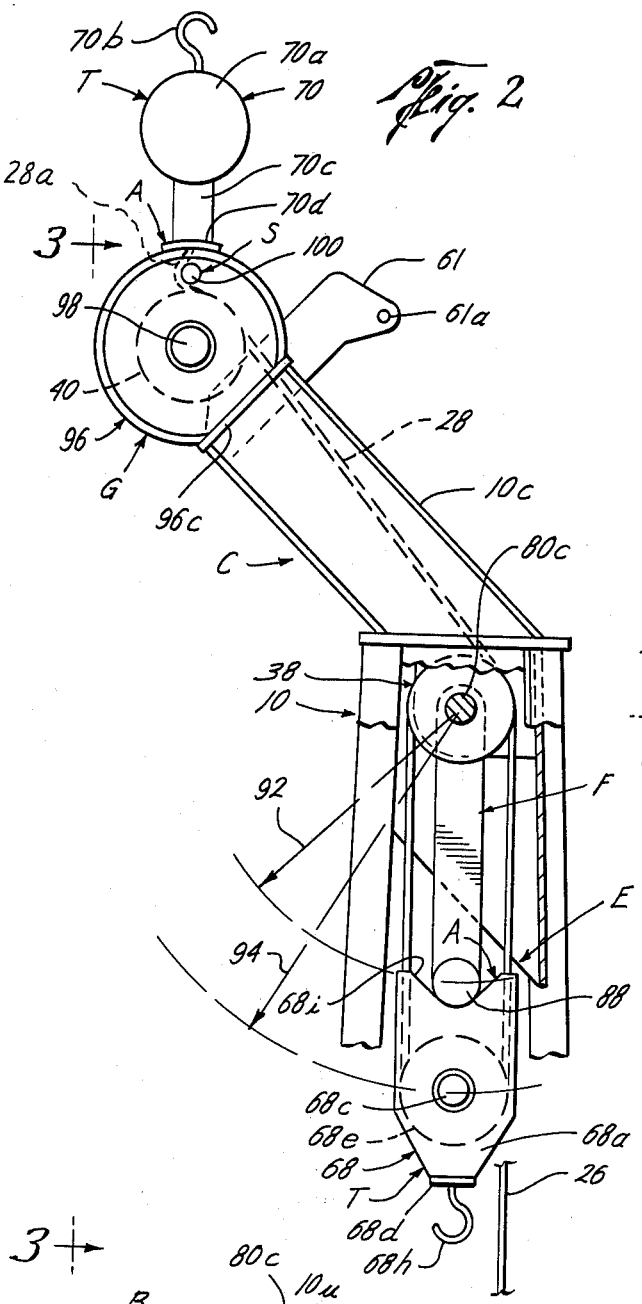
FIG. 2 is an enlarged elevational, sectional view of the boom tip of the crane assembly of FIG 1, showing the anti-two block system of the present invention.

The engaging means E of the present invention is preferably mounted with the frame member F for engaging the travelling member T as necessary. The engaging means E may include engaging member 88 mounted with the lower end of the singular support member 82 or an engaging member 90 mounted with the lower ends of the support members 84, 86. Engaging members 88, 90 may be of any suitable configuration. For example, as shown in FIG. 2, the engaging member 88 is of a circular cross section; however, any suitable cross section of engaging means E may be used as is necessary. Preferably, the engaging members 88, 90 and the abutting means A are formed having compatible engaging surfaces such as the abutting detent 68*i* being compatible with the engaging member 88 as shown in FIG. 2. The engaging members 88, 90 must be of a sufficient length such that the abutting means A with both side supports 68*a*, 68*b* of the travelling block 68 may come into contact with the engaging member 88 with frame member F. Thus, the engaging members 88, 90 are mounted with the frame member F for engaging the travelling member T adjacent the abutting means A which is formed with the travelling member T for abutting the engaging members 88, 90 when the travelling member T is moved into close proximity of the boom tip 10*c*.

Since the frame member F is pivotally mounted on the sheave axle 80*c* of the sheave carrier 80, the frame member F is adapted to pivot about an arc designated generally as 92 as the boom 10 of the crane assembly C is raised and lowered during lifting operations. Similarly, the travelling member T is adapted to pivot about an arc described generally as 94 as the boom tip 10*c* of the boom 10 is raised and lowered during lifting operations. Because the frame member F and travelling member T rotate about the same axis, namely the sheave axle 80*c* of the sheave carrier 80, irrespective of the boom angle with respect to the ground, the frame member F having the engaging means E therewith will be aligned with the abutting means A with the travelling member T. Accordingly, during lifting operations, should the travelling member T be inadvertently lifted to the point where the travelling member T actually engages the engaging means E of the anti-two block system B of the present invention, the travelling member T will be prevented from doing actual damage to the boom tip 10*c* of the pedestal crane assembly C.

As noted hereinabove, the main hoist line 26 is preferably hydraulically actuated by main hoist 22 such that when the abutting means A engages the engaging means E, an increase in hydraulic pressure will be registered adjacent the upper works 12 of the crane assembly C. An appropriate pressure relief valve (not shown) incorporated into the hydraulic system, will prevent undue stretching and possible snapping of the main hoist line 26 and also act as an indicator of engagement between the engaging means E and abutting means A. Thus, the frame member F having the engaging means E therewith and the travelling member T both pivot about the sheave carrier 80 such that the frame member F and travelling member T are at substantially the same angle with respect to the boom 10 during lifting operations.

The anti-two block system B of the present invention may also be incorporated with the ball-hook assembly designated generally as 70. The ball-hook assembly 70 includes a typically weighted ball 70*a* having appropriate hook 70*b* attached therewith, with the hook 70*b* being adapted for lifting loads by the crane assembly C. Preferably, a collar 70*c* is mounted with the ball 70*a* in a position opposed to that of the hook 70*b*. Abutting means A is mounted with the collar 70*c* and includes an arcuate abutting member 70*d* fixed with collar 70*c* as discussed more fully hereinbelow.

The guide member G includes a guide member generally designated as 96 and is preferably mounted with the crane assembly C adjacent boom tip 10*c* of the boom 10. The guide member G includes preferably at least two substantially parallel guide plates 96*a*, 96*b* mounted with guide support plate 96*c* which in turn is mounted with the boom tip 10*c* of the crane assembly C. Preferably, the guide plates 96*a*, 96*b* are formed having engaging surfaces 96*d*, 96*e*, respectively, at least a portion of which are circular. A sheave carrier 98 is supported by the guide plates 96*a*, 96*b* and is adapted to receive sheave 40 between such guide plates 96*a*, 96*b* for support by the sheave carrier 98.

Stop means S is preferably mounted with and between the guide plates 96*a*, 96*b* of the guide member 96 and with the travelling member T for preventing the travelling member T from damaging the boom tip 10*c* of the crane assembly C as necessary. The stop means S includes a stop bar 100 mounted with the guide member 96 between guide plates 96*a*, 96*b* in a substantially parallel relation to the sheave carrier 98. The stop means S further includes a portion 28*a* of the auxiliary hoist line 28 that may be adjacent the stop bar 100. When lifting a load with the ball-hook assembly 70 during raising and/or lowering operations of the crane assembly C, should the ball-hook assembly 70 come into close proximity with the guide member G, the abutting means A including arcuate abutting member 70*d* may contact the correspondingly formed exterior engaging surfaces 96*d*, 96*e* of the guide members 96, while the auxiliary hoist line 28 causes the ball-hook assembly 70 to be drawn about the guide member G as it is retracted. The ball-hook assembly 70 may swing about the guide member G for substantially a maximum of 180° until such time that the portion 28*a* of the auxiliary hoist line 28 engages stop means S when the abutting means A including the arcuate abutting member 70*d* engages engaging surfaces 96*d*, 96*e* of the guide member 96 adjacent to the stop bar 100.

Thus, the ball-hook assembly 70 comes to rest in the position best seen in FIG. 2. Due to the engagement between the travelling member T and the guide member G, the hoist line 28 experiences a stretching or tensioning force, which is transmitted by the hoist line 28 to the auxiliary hoist 24. As a consequence, the auxiliary hoist 24 stalls when the maximum hoist line tension is reached, with the point at which stalling occurs being regulated by a pressure relief valve having an appropriate relief valve setting. Thus, the portion 28*a* of the auxiliary hoisting line 28 engages the stop bar 100 when the arcuate abutting member 70*d* engages the circular engaging surfaces 96*d*, 96*e* of the guide member 96 of the guide member G adjacent the stop bar 100 of the stop means S to protect the boom tip 10*c*, as necessary. The substantially circular engaging surfaces 96*d*, 96*e* act to guide the arcuate abutting member 70*d* of the ball-hook assembly 70 about the guide member G to allow the auxiliary hoist line 28 of the crane assembly C to engage the stop bar 100 to protect the boom tip 10*c* of the crane assembly C. Furthermore, during operations of the crane assembly C wherein the ball-hook assembly 70 is not needed, the ball-hook assembly 70 may be parked in the position substantially as shown in FIG. 2 to effectuate and prevent the interference of the ball-hook assembly 70 of the travelling member T with that of the travelling block 68 of the travelling member T. In its parked position, the ball-hook assembly 70 cannot interfere with operation of the travelling block 68 and eliminates the risk of entanglement of the auxiliary hoist line 28 with that of the main hoist line 26.

Therefore, the anti-two block system B of the present invention provides a new and useful mechanism for preventing two blocking of travelling members T adjacent the boom tip 10*c* of a crane assembly C. Furthermore, the anti-two block system B of the present invention is effective at all boom angles because the system is capable of pivoting and/or rotating as the boom 10 of the crane assembly C is either raised and/or lowered during lifting operations and at worst, results in the travelling members T standing off from the boom tip 10*c* for the prevention of damage thereto.

The foregoing disclosure and description of the invention are illustrative and explanatory thereof, and various changes in the size, shape and materials as well as in the details of the illustrated construction may be made without departing from the spirit of the invention.

We claim:

1. An anti-two block system adapted to be used with a crane, the crane having a boom with a boom tip, the boom tip having sheaves mounted on a sheave carrier therewith, the crane adapted to lift loads with a hydraulically actuated hoist line extending over the sheaves and having a travelling member affixed therewith, comprising:

a frame member pivotally mounted with the sheave carrier adjacent the sheaves for unencumbered rotation about the sheave carrier as the boom tip moves during lifting operations; and, engaging means mounted with said frame member adjacent the boom tip for engaging the travelling member when the travelling member moves to a fixed distance within close proximity to the boom tip during lifting operations of the travelling member with the crane, said engaging means including an engaging member mounted with said frame member for engaging the travelling member at said fixed distance and preventing further movement of the travelling member towards the boom tip.

2. The anti-two block system of claim 1, further including:

abutting means formed with the travelling member for abutting said engaging member when the travelling member is moved to said fixed distance within close proximity of the boom tip to prevent damage to the boom tip of the crane by the travelling member.

3. The anti-two block system of claim 2, wherein:

said engaging member and said abutting means are formed having compatible engaging surfaces.

4. The anti-two block system of claim 1, wherein:

said frame member having said engaging member therewith and the travelling member both pivot about the sheave carrier such that said frame member and the travelling member are at substantially the same angle with respect to the boom during lifting operations.

5. An anti-two block system adapted to be used with a crane, the crane having a boom with a boom tip, the boom tip having sheaves mounted on a sheave carrier therewith, the crane adapted to lift loads with a hydraulically actuated hoist line extending over the sheaves and having a travelling member affixed therewith, comprising:

engaging means mounted with the boom tip for engaging the travelling member when the travelling member moves into close proximity to the boom tip during lifting operations of the travelling member with the crane;

said engaging means includes a guide member and stop means;

said guide member having a guide member sheave and a substantially circular engaging surface formed with said guide member, said guide member sheave mounted with the boom tip for receiving the hoist line in engagement therewith, said guide member sheave mounted for rotation about the sheave carrier; and, said stop means mounted with said guide member and including a stop bar mounted with said guide member and spaced from said guide member sheave a distance slightly greater than the diameter of the hoist line for preventing the travelling member from damaging the boom tip of the crane during lifting operations of the travelling member.

6. The anti-two block system of claim 5, wherein said stop means includes:

abutting means with the travelling member for abutting said guide member when in close proximity to the boom tip.

7. The anti-two block system of claim 6, wherein:

said abutting means includes an arcuate abutting member mounted with the travelling member; and, said stop bar engages the hoist line of the crane when said arcuate abutting member of the travelling member engages said circular engaging surface of said guide member adjacent said stop bar to protect the boom tip, as necessary.

8. The anti-two block system of claim 7, wherein:

said circular engaging surface guides said arcuate abutting member of the travelling block about said guide member to allow the hoist line of the crane to engage said stop bar to protect the boom tip as necessary.

9. The anti-two block system of claim 8, wherein:

said circular engaging surface of said guide member when engaging said arcuate abutting member provides a location for parking the travelling member away from other crane operations to prevent entanglement of the travelling member and hoist lines with the other crane operations.

* * * * *